US007981013B2

(12) United States Patent
Krull

(10) Patent No.: US 7,981,013 B2
(45) **Date of Patent: *Jul. 19, 2011**

(54) KETTLEBELL APPARATUS

(76) Inventor: Mark A. Krull, Bend, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/590,355

(22) Filed: Nov. 6, 2009

(65) Prior Publication Data

US 2010/0120589 A1 May 13, 2010

Related U.S. Application Data

(60) Provisional application No. 61/198,620, filed on Nov. 7, 2008.

(51) Int. Cl.
*A63B 21/075* (2006.01)

(52) U.S. Cl. ..... 482/108; 482/107; 482/908

(58) Field of Classification Search ..... 482/44, 482/49, 50, 92–94, 98, 99, 106–110, 141, 482/97, 908
See application file for complete search history.

(56) References Cited

U.S. PATENT DOCUMENTS

| | | | | | |
|---|---|---|---|---|---|
| 90,304 | A * | 5/1869 | Reilly | 482/94 |
| 1,138,196 | A * | 5/1915 | Diehl | 482/106 |
| 1,316,683 | A * | 9/1919 | Calvert | 482/93 |
| 1,779,594 | A * | 10/1930 | Hall | 482/107 |
| 1,917,566 | A * | 7/1933 | Wood | 482/108 |
| 5,846,313 | A * | 12/1998 | Chuang | 106/705 |
| 7,052,445 | B2 * | 5/2006 | Ekhaus | 482/93 |
| 7,381,157 | B2 * | 6/2008 | Blateri | 482/50 |
| 7,491,157 | B1 * | 2/2009 | Lin | 482/108 |
| 7,563,208 | B1 * | 7/2009 | Chen | 482/93 |
| 7,678,031 | B2 * | 3/2010 | Ngu | 482/107 |
| 7,731,640 | B1 * | 6/2010 | Chen | 482/93 |
| 7,762,933 | B1 * | 7/2010 | Yu | 482/107 |
| 2005/0003931 | A1 * | 1/2005 | Mills et al. | 482/5 |
| 2007/0203001 | A1 * | 8/2007 | Krull | 482/94 |
| 2008/0081744 | A1 * | 4/2008 | Gormley | 482/93 |
| 2009/0062085 | A1 * | 3/2009 | Polevoy et al. | 482/93 |
| 2010/0120588 | A1 * | 5/2010 | Krull | 482/93 |
| 2011/0028285 | A1 * | 2/2011 | Towley et al. | 482/108 |

FOREIGN PATENT DOCUMENTS

| | | | |
|---|---|---|---|
| JP | 2007021123 | A * | 2/2007 |
| SU | 1738294 | A1 * | 6/1992 |
| SU | 1759440 | A1 * | 9/1992 |

* cited by examiner

*Primary Examiner* — Loan Thanh
*Assistant Examiner* — Victor K Hwang

(57) ABSTRACT

An adjustable weight kettlebell includes a weight lifting member that rests on top of a vertical stack of weights. A weight selector is rotatable into and out of underlying engagement of the weight plates to secure a desired amount of mass to the weight lifting member.

11 Claims, 6 Drawing Sheets

KETTLEBELL APPARATUS

CROSS-REFERENCE TO RELATED APPLICATIONS

Disclosed herein is subject matter that is entitled to the filing date of U.S. Provisional Application No. 61/198,620, filed on Nov. 7, 2008.

FIELD OF THE INVENTION

The present invention relates to exercise equipment and in a preferred application, to methods and apparatus for adjusting weight on an exercise kettlebell.

BACKGROUND OF THE INVENTION

Past efforts have led to various inventions directed toward adjustable weight exercise devices. Despite these advances and others in the field of weight lifting equipment, room for continued improvement remains with respect to adjusting weight resistance to exercise.

SUMMARY OF THE INVENTION

The present invention provides methods and apparatus involving the movement of mass subject to gravitational force. In a preferred application, the present invention allows a person to adjust weight resistance by securing desired amounts of mass to a handlebar or other weight lifting member. A preferred embodiment of the present invention may be described in terms of a kettlebell having a handle, a weight supporting section secured to the handle and disposed beneath the handle, and a weight selector that is rotatably mounted on the weight supporting section. Weights are sized and configured to occupy the weight supporting section, and to be selectively engaged and disengaged in response to rotation of the weight selector. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
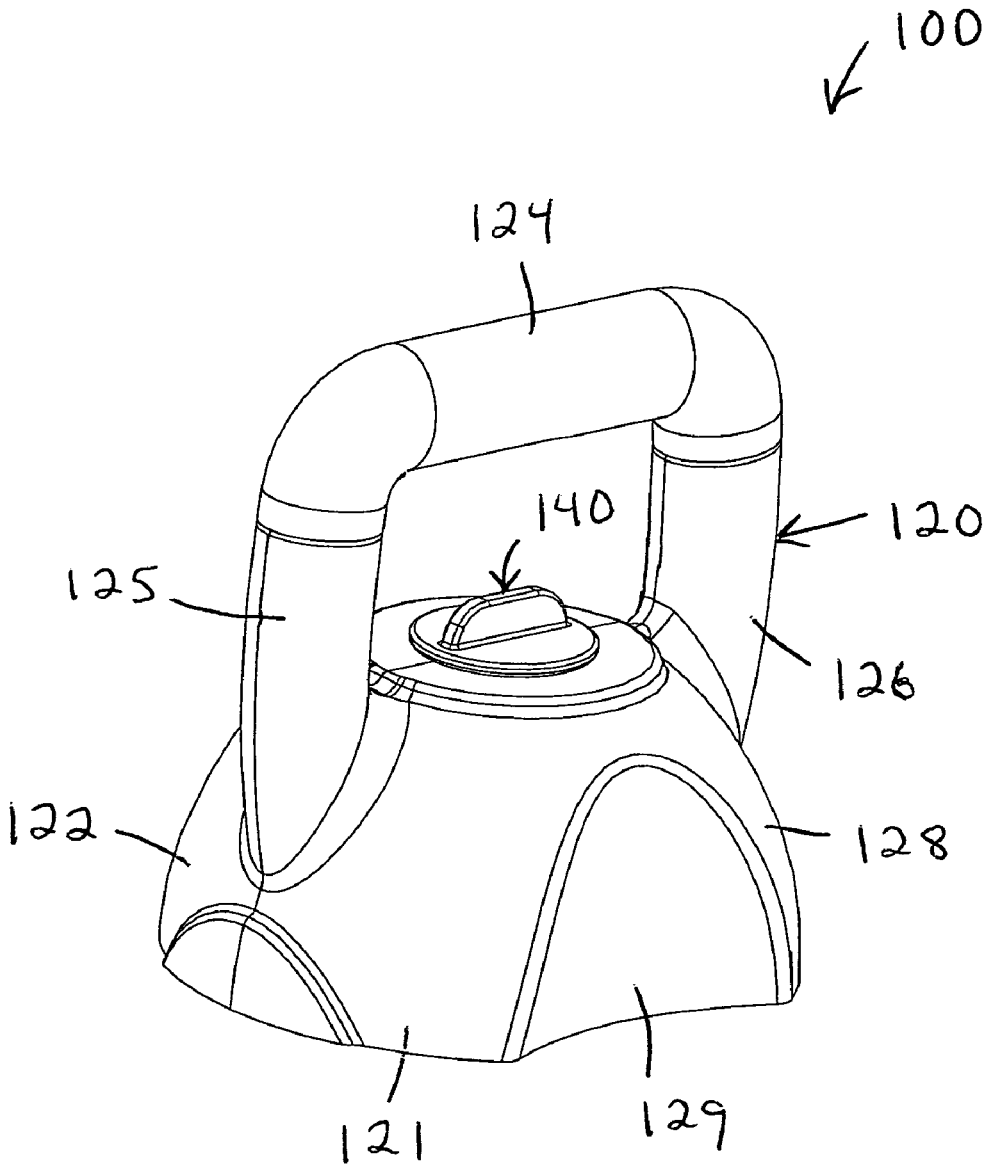
FIG. 1 is a perspective view of an adjustable weight kettlebell constructed according to the principles of the present invention.
Figure 2:
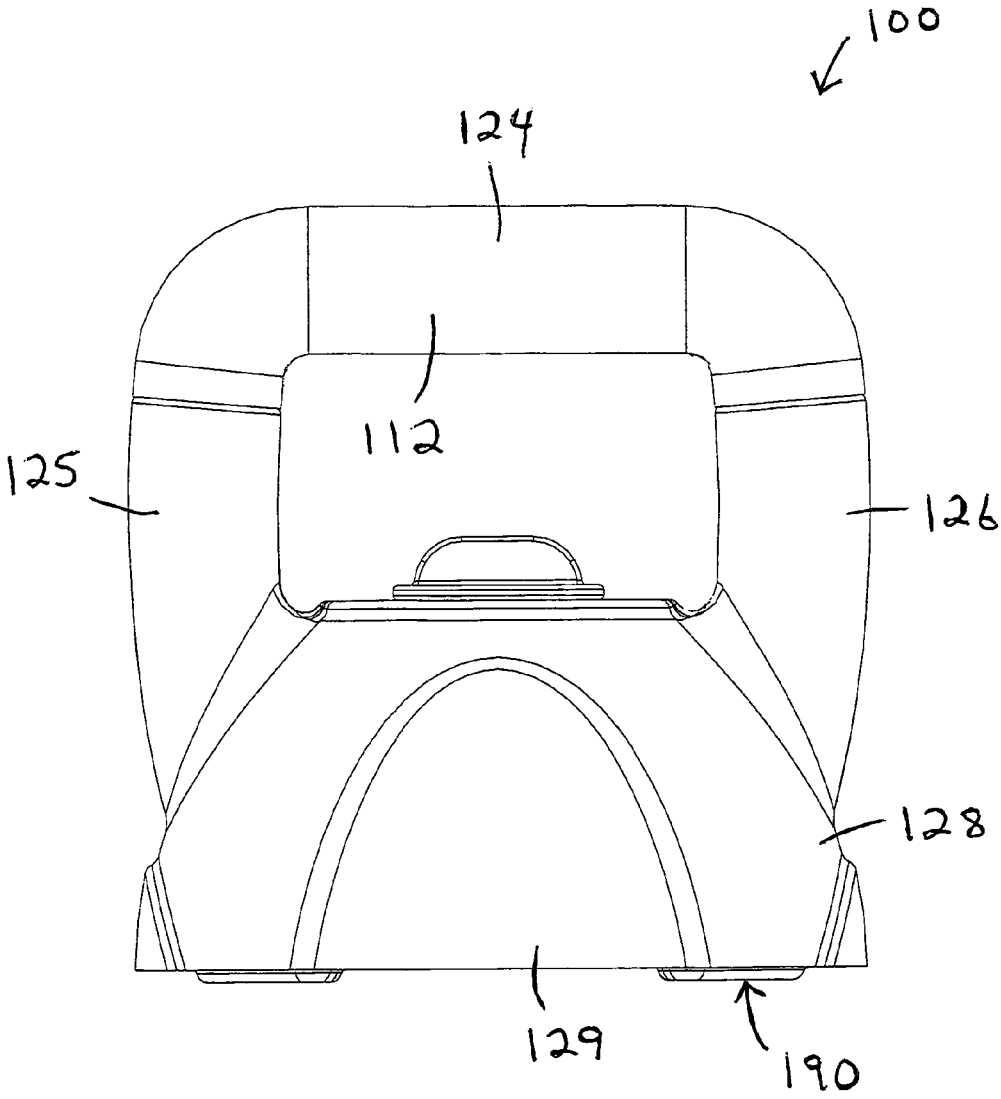
FIG. 2 is a front view of the kettlebell of FIG. 1.

FIGS. 1-2 show a preferred embodiment kettlebell 100 constructed according to the principles of the present invention. Generally speaking, the kettlebell 100 includes a weight lifting member or handle member 120, and (as shown in FIG. 3) at least two weights 180 and 190 selectively secured thereto by means of a weight selector 140 that is rotatably mounted on the weight lifting member 120.

The weight lifting member 120 is preferably made by connecting two injection molded parts or halves 121 and 122 to one another (via sonic welding, adhesive, fasteners, snap fit, and/or other suitable means known in the art). The weight lifting member 120 includes a centrally located, horizontal handlebar 124 that is sized and configured for grasping, and that preferably has an oval cross-section. The handlebar 124 is integrated into the molded parts 121 and 122, but may be provided as a separate part in the alternative. The handlebar 124 is shown with a vinyl overcoat 112. The weight lifting member 120 also includes left and right, vertical handle segments 125 and 126, which cooperate with the handlebar 124 to define an inverted U-shaped handle having three discrete graspable segments.

Figure 3:
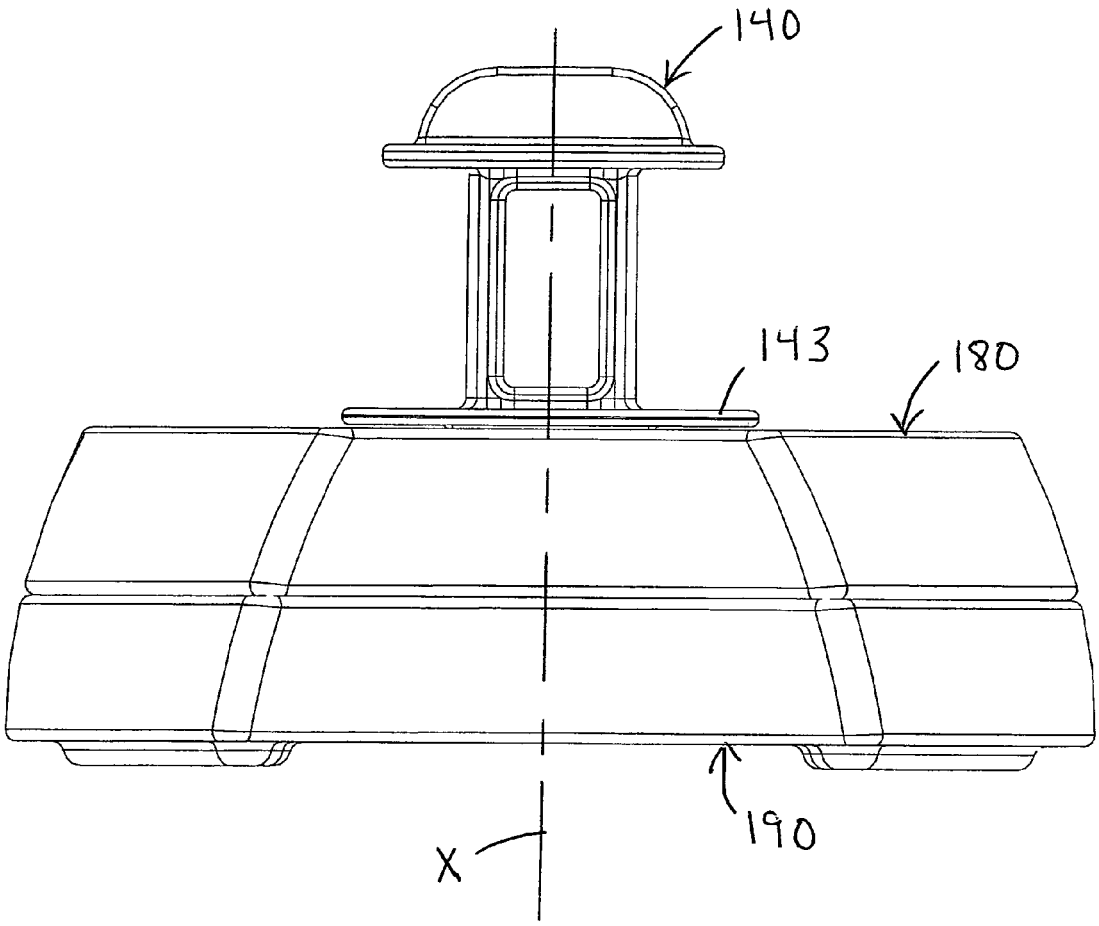
FIG. 3 is a front view of certain components of the kettlebell of FIG. 1, including a stack of weight plates and a weight selector.
Figure 5:
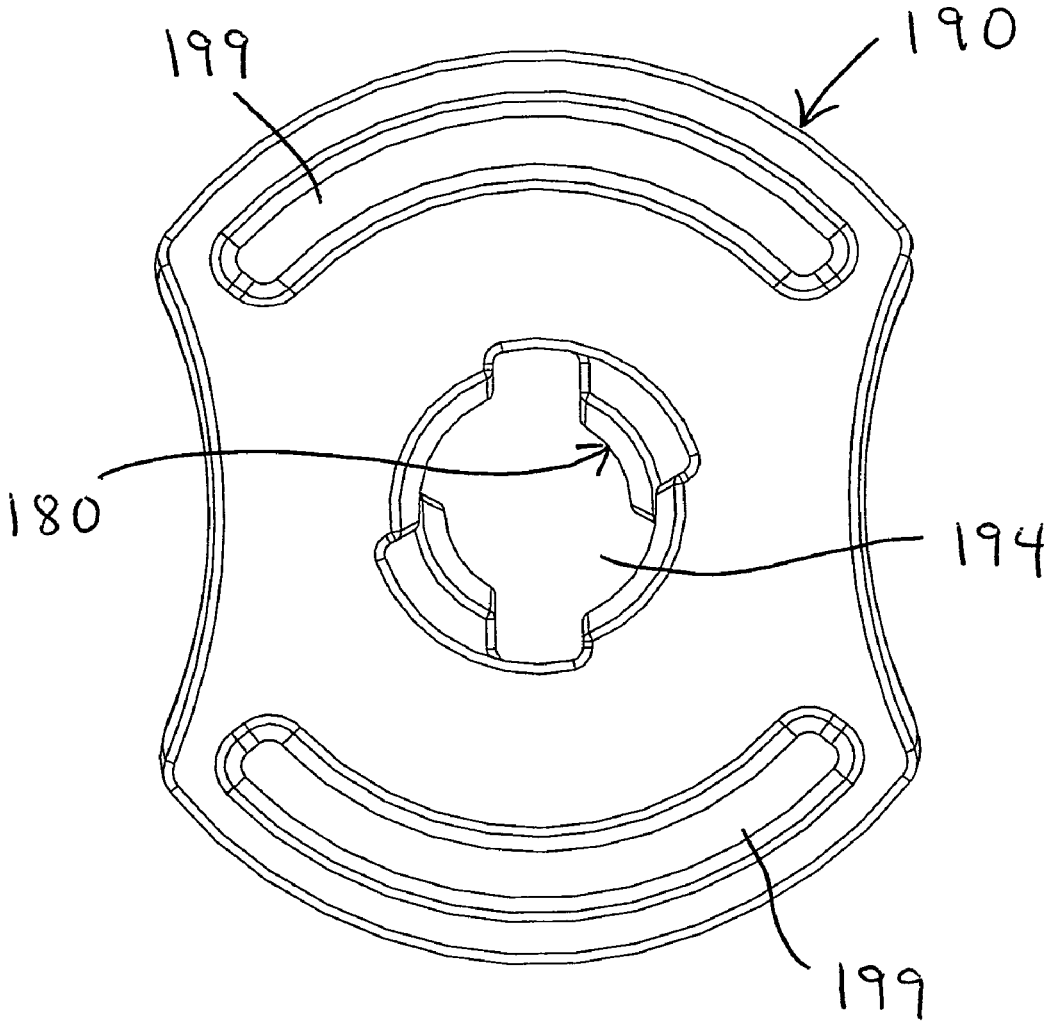
FIG. 5 is a bottom view of the stacked weight plates of FIG. 3.
Figure 6:
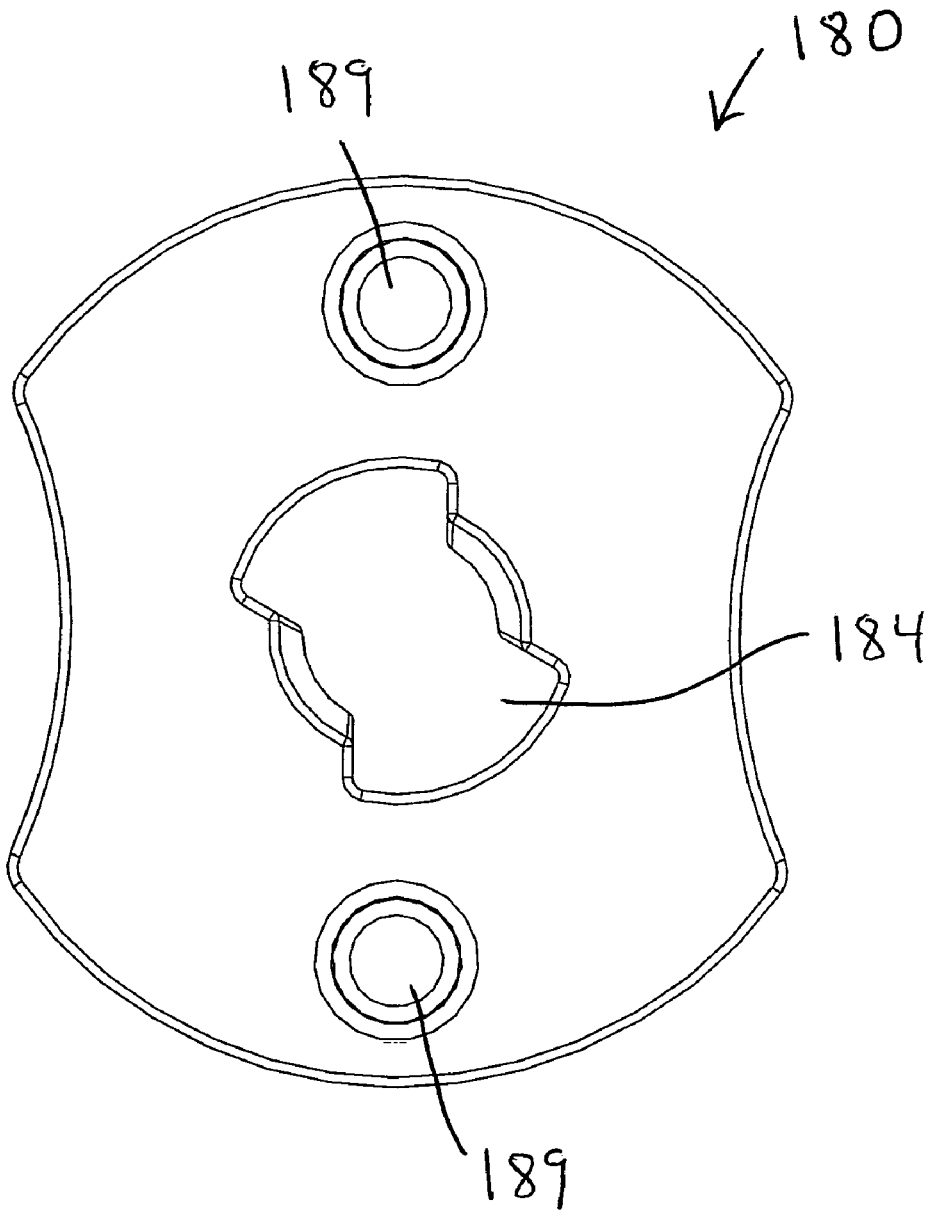
FIG. 6 is a bottom view of the uppermost weight plate of FIG. 3.

The lower ends of the segments 125 and 126 are connected to a weight supporting section 128, which may be described as a downwardly opening housing or box that is sized and configured to cover or fit over the weights 180 and 190 (shown in FIGS. 3 and 5-6). The resulting housing may also be described in terms of shrouding an interface defined between the weights 180 and 190, thereby reducing the likelihood of a person being pinched. The weight supporting section 128 cooperates with a peripheral portion of at least the upper weight 180 to maintain a desired orientation between the weight lifting member 120 and at least the upper weight 180. Recesses or scallops 129 are provided in the front and back sidewalls of the housing 128 to accommodate or bear against a person's forearm.

The weight lifting member 120 is also preferably configured to receive and retain a fixed weight or ballast between the two molded parts 121 and 122. On the depicted embodiment 100, the ballast cooperates with the other parts of the handle member 120 to define a starting weight or unloaded weight of four pounds. Each of the weights 180 and 190 is also configured to weigh four pounds. In other words, the kettlebell 100 is selectively adjustable between four and twelve pounds in four pound increments.

Figure 4:
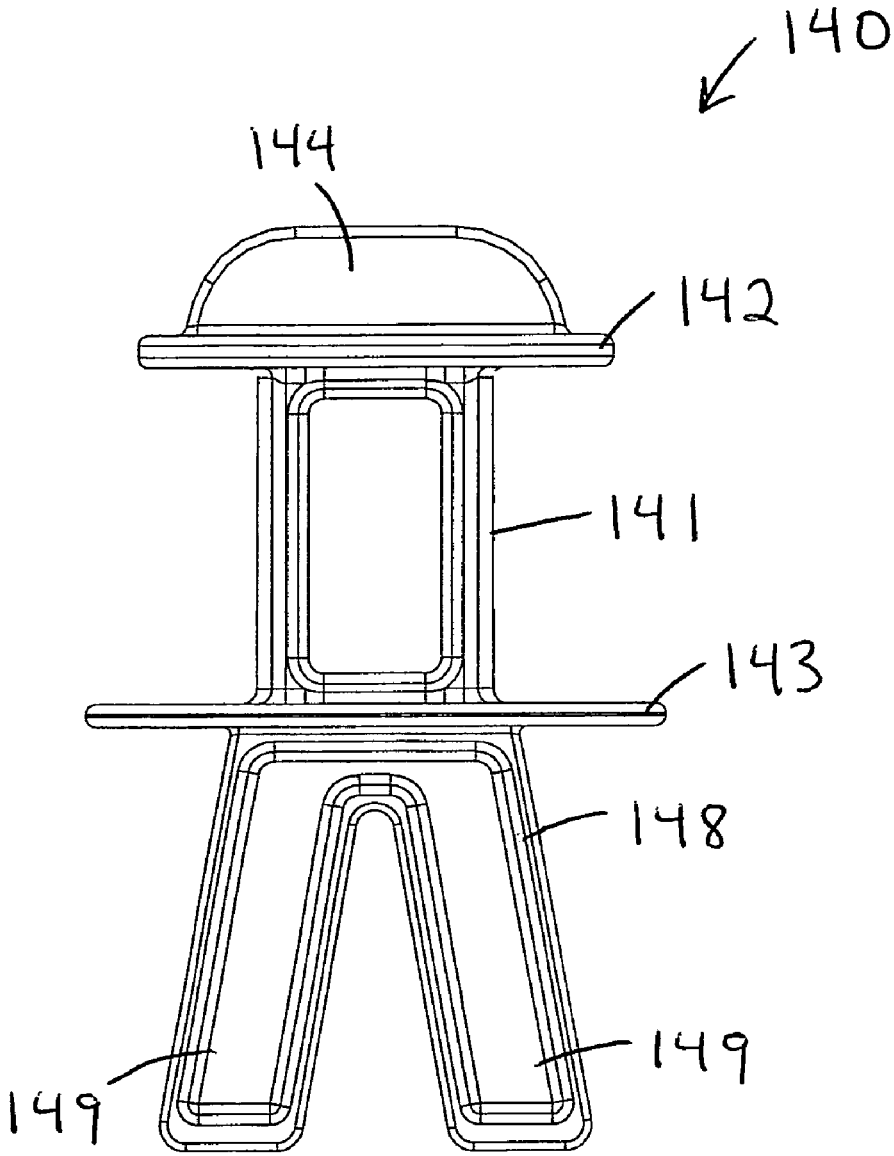
FIG. 4 is a front view of the weight selector of FIG. 3.

The weight selector 140, which is preferably a unitary piece of injection molded plastic, is shown by itself in FIG. 4. The weight selector 140 includes a neck or shaft 141 that extends between a pair of flanges 142 and 143. The weight lifting member parts 121 and 122 include wall sections that fit between the flanges 142 and 143 and about the shaft 141 to rotatably connect the weight selector 140 to the weight lifting member 120. A tab or handle 144 projects upward from the upper flange 142 and is sized and configured for manual operation. The tab 144 and the upper flange 142 may be alternatively described as a knob. An inverted V-shaped tab 148 projects downward from the lower flange 143 and selectively engages the upper weight 180, as further described below. Diametrically opposed prongs 149 project downward from opposite sides of the tab 148 to selectively engage the lower weight 190, as further described below.

The tab 148 may be described as an upper weight retaining member, and the prongs 149 may be described as a lower weight retaining member, and the tab 148 may be described as interconnected in series between the prongs 149 and the shaft 141. In the alternative, the tab 148 and the prongs 149 may be described collectively as a unitary weight retaining member, in which case, the tab 148 may be described as an upper portion of the weight retaining member, and each prong 149 may be described as a lower portion of the weight retaining member.

Different arrangements or means may be used to bias the weight selector 140 toward desired orientations relative to the weight engaging section 126 and the weights 180 and 190, and/or to lock the weight selector 140 in desired orientations relative to the weight engaging section 128 and the weights 180 and 190. For example, a leaf spring may be integrated into the weight selector 140 and biased to occupy detent locations defined by the weight lifting member 120 and arranged in an arc about the flange 142. In the alternative, a plunger may be mounted on the weight lifting member 120 and biased to occupy detent locations defined by the flange 142 and disposed circumferentially about the flange 142.

The weights 180 and 190 are stacked as shown in FIG. 3 to accommodate enclosure within the weight supporting housing 128, and to accommodate insertion of the weight selector 140 into openings in the weights 180 and 190. A bottom view of the weight stack is shown in FIG. 5, and a bottom view of the upper weight 180 is shown in FIG. 6.

The upper weight 180 is preferably an injection molded plastic shell that surrounds and contains a relatively denser filler material, and the weight 180 may be described as a plate having a thickness that is measured parallel to the selector axis of rotation X. The upper weight plate 180 preferably includes openings or depressions in its upwardly facing or top surface that register with pegs that project downward from the weight housing 128. The pegs on the weight housing 128 cooperate with the openings to maintain a fixed orientation between the weight lifting member 120 and the weight plate 180 when the former is adjacent the latter. The upper weight plate 180 also includes pegs 189 that project downward from its downwardly facing or bottom surface. The pegs 189 on the upper weight plate 180 cooperate with openings or depressions in the lower weight plate 190 to maintain a fixed orientation between the upper weight plate 180 and the lower weight plate 190 when the former is adjacent the latter.

A centrally located hole 184 extends through the upper weight plate 180, in a direction perpendicular to the thickness of the upper weight plate 180. The hole 184 may be described in terms of a conical bore and a straight-walled slot or keyway that intersect with one another. The slot accommodates passage of the weight selector 140 through the upper weight plate 180 when properly oriented relative thereto. The bore accommodates rotation of the weight selector 140 when the tab 148 occupies the hole 184, and the sidewalls of the bore overlie the tab 148 when the weight selector 140 is properly oriented relative thereto.

The lower weight 190 is also preferably an injection molded plastic shell that surrounds and contains a relatively denser filler material, and the weight 190 may also be described as a plate having a thickness that is measured parallel to the selector axis of rotation X. The lower weight plate 190 preferably includes openings or depressions in its upwardly facing or top surface that register with the pegs 189 that project downward from the upper weight plate 180. The pegs 189 on the upper weight plate 180 cooperate with the openings in the lower weight plate 190 to maintain a fixed orientation between the weight plates 180 and 190 when they are stacked as shown in FIG. 3. The lower weight plate 190 also preferably includes protrusions or ridges 199 that project downward from its downwardly facing or bottom surface, thereby elevating the bulk of the weight plate 190 relative to an underlying support surface.

A centrally located hole 194 extends through the lower weight plate 190, in a direction perpendicular to the thickness of the lower weight plate 190. The hole 194 may be described in terms of a conical bore and a straight-walled keyway or slot that intersect with one another. The slot accommodates passage of the weight selector 140 through the lower weight plate 190 when properly oriented relative thereto. The bore accommodates rotation of the weight selector 140 when the prongs 149 occupy the hole 194, and the sidewalls of the bore overlie the prongs 149 when the weight selector 140 is properly oriented relative thereto. The openings 194 and 184 cooperate to define three different weight selecting orientations for the weight selector 140, sixty degrees apart from one another.

When the tab 148 and the prongs 149 are aligned with the slots in both weight plates 180 and 190, the tab 148 is free to move upward relative to the upper weight plate 180, and the prongs 149 are free to move upward relative to both weight plates 180 and 190, so the weight lifting member 120 is free to move upward relative to both weight plates 180 and 190 (in response to a lifting force of at least four pounds).

When the tab 148 and the prongs 149 are rotated beneath the angled sidewalls in the upper weight plate 180, the tab 148 underlies the upper weight plate 180, and the prongs 149 are free to move upward relative to the lower weight plate 190, so only the upper weight plate 180 is constrained to move upward together with the weight lifting member 120 (in response to a lifting force of at least eight pounds).

When the prongs 149 are rotated beneath the angled sidewalls in the lower weight plate 190, the prongs 149 underlie the lower weight plate 190, so both weight plates 180 and 190 are constrained to move upward together with the weight lifting member 120 (in response to a lifting force of at least twelve pounds). When the selector 140 is oriented in this manner on the depicted embodiment 100, the tab 148 rotates out from under the upper weight plate 180, so the weight of both weight plates 180 and 190 is carried by the prongs 149. On an alternative embodiment, the upper weight plate may be configured with a relative smaller slot to keep the selector tab in engagement with the upper weight plate when the lower weight plate is engaged by the prongs.

The present invention has been described with reference to specific embodiments and a preferred application. Recognizing that this disclosure will enable persons skilled in the art to derive various modifications, improvements, and/or applications that nonetheless embody the essence of the invention, the scope of the present invention is to be limited only to the extent of the following claims.

What is claimed is:

1. An adjustable weight kettlebell, comprising:

a stack of weights, including an upper weight stacked on top of a lower weight;

a weight lifting member configured and arranged to rest in a prescribed position on top of the stack of weights, wherein the weight lifting member includes (a) a handle having a hand grip configured and arranged for grasping in a person's hand at a location disposed vertically above the stack of weights when the weight lifting member is resting on top of the stack of weights, (b) a weight selector movable into and out of underlying engagement with the weights; and (c) a manually operable knob disposed vertically beneath the handle and vertically above the weights when the weight lifting member is resting on top of the stack of weights, wherein the weight selector moves in response to rotation of the knob.

2. The adjustable weight kettlebell of claim 1, wherein the weight selector rotates out from underlying engagement of the upper weight when it rotates into underlying engagement with the lower weight.

3. The adjustable weight kettlebell of claim 1, wherein a protuberance projects outward from one said weight and into a depression in an adjacent said weight to maintain a desired orientation between the one said weight and the adjacent said weight.

4. The adjustable weight kettlebell of claim 3, wherein a weight engaging portion of the weight lifting member is configured to engage the upper weight in a manner that maintains a desired orientation between the weight lifting member and the upper weight.

5. The adjustable weight kettlebell of claim 1, wherein the weight lifting member is configured to define a housing above and around at least the upper weight when the weight lifting member is resting on the stack of weights.

6. The adjustable weight kettlebell of claim 5, wherein the housing cooperates with a peripheral portion of the upper weight to maintain a desired orientation between the weight lifting member and the upper weight.

7. The exercise apparatus of claim 1, wherein the handle has opposite first and second ends that are rigidly connected to discrete structural portions of the weight lifting member.

8. An exercise apparatus, comprising:

a stack of weights, including an upper weight that defines a first opening, and a lower weight that defines a second opening, wherein the upper weight is configured to occupy a prescribed position on top of the lower weight;

a weight lifting member configured to rest on top of the stack of weights;

a weight selector rotatably mounted on the weight lifting member for rotation about an axis relative to the weight lifting member, wherein the weight selector has downwardly diverging sidewalls, and when the weight lifting member is resting on top of the stack of weights, the downwardly diverging sidewalls are selectively rotatable into underlying engagement of each said weight; and when the weight selector occupies a first orientation relative to the stack of weights, the weight selector is free to move upward relative to each said weight, whereby the weight lifting member is liftable without any said weight; and when the weight selector occupies a second orientation relative to the stack of weights, the weight selector underlies only the upper weight, whereby the weight lifting member is liftable together with the upper weight; and when the weight selector occupies a third orientation relative to the stack of weights, the weight selector underlies at least the lower weight, whereby the weight lifting member is liftable with each said weight.

9. The exercise apparatus of claim 8, wherein the weight lifting member includes a handle having a hand grip configured and arranged for grasping at a location disposed vertically above the stack of weights when the weight lifting member is resting on top of the stack of weights.

10. An exercise apparatus, comprising:

a stack of weights, including an upper weight that defines a first opening, and a lower weight that defines a second opening, wherein the upper weight is configured to occupy a prescribed position on top of the lower weight;

a weight lifting member configured to rest on top of the stack of weights;

a weight selector rotatably mounted on the weight lifting member for rotation about an axis relative to the weight lifting member, wherein when the weight lifting member is resting on top of the stack of weights, a first portion of the weight selector is selectively rotatable into underlying engagement of the upper weight at a first maximum radial distance from the axis, and a second portion of the weight selector is selectively rotatable into underlying engagement of the lower weight at a relatively greater, second maximum radial distance from the axis; and when the weight selector occupies a first orientation relative to the stack of weights, the weight selector is free to move upward relative to each said weight, whereby the weight lifting member is liftable without any said weight; and when the weight selector occupies a second orientation relative to the stack of weights, the weight selector underlies only the upper weight, whereby the weight lifting member is liftable together with the upper weight; and when the weight selector occupies a third orientation relative to the stack of weights, the weight selector underlies at least the lower weight, whereby the weight lifting member is liftable with each said weight.

11. The exercise apparatus of claim 10, wherein the weight lifting member includes a handle having a hand grip configured and arranged for grasping at a location disposed vertically above the stack of weights when the weight lifting member is resting on top of the stack of weights.

* * * * *